US009597870B2

(12) United States Patent
Sakurai et al.

(10) Patent No.: US 9,597,870 B2
(45) Date of Patent: Mar. 21, 2017

(54) INKJET PRINT HEAD

(71) Applicant: CANON KABUSHIKI KAISHA, Tokyo (JP)

(72) Inventors: Masataka Sakurai, Kawasaki (JP); Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 13/672,024

(22) Filed: Nov. 8, 2012

(65) Prior Publication Data

US 2013/0120502 A1 May 16, 2013

(30) Foreign Application Priority Data

Nov. 15, 2011 (JP) ..... 2011-249621
Oct. 19, 2012 (JP) ..... 2012-231651

(51) Int. Cl.
*B41J 2/14* (2006.01)

(52) U.S. Cl.
CPC ..... *B41J 2/14072* (2013.01)

(58) Field of Classification Search
USPC ..... 347/58–75
See application file for complete search history.

(56) References Cited

U.S. PATENT DOCUMENTS 6,447,088 B2 9/2002 Tachihara et al.
6,543,884 B1 4/2003 Kawamura et al.
6,918,657 B2 7/2005 Kawamura et al.
7,240,989 B2 * 7/2007 Tomita et al. ..... 347/48
7,263,773 B2 * 9/2007 Lee ..... B41J 2/14056 216/27
7,690,768 B2 * 4/2010 Eguchi et al. ..... 347/56
7,832,843 B2 11/2010 Oikawa et al.
7,896,474 B2 3/2011 Kasai et al.
7,905,577 B2 * 3/2011 Takeuchi et al. ..... 347/56
8,147,039 B2 4/2012 Kurokawa et al.
8,342,658 B2 1/2013 Tsuchii et al.
8,523,325 B2 9/2013 Sakurai et al.
8,721,047 B2 5/2014 Sakurai et al.
8,783,833 B2 7/2014 Tsuchii et al.
2004/0036723 A1 * 2/2004 Eguchi et al. ..... 347/9
(Continued)

FOREIGN PATENT DOCUMENTS

JP 09-254413 A 9/1997
JP 2001-71502 A 3/2001
(Continued)

OTHER PUBLICATIONS

Office Action dated Jun. 28, 2016, in Japanese Patent Application No. 2012-231651.

*Primary Examiner* — Matthew Luu
*Assistant Examiner* — Lily Kemathe
(74) *Attorney, Agent, or Firm* — Fitzpatrick, Cella, Harper & Scinto

(57) ABSTRACT

Provided is an inkjet print head in which, without causing an increase in print head size, printing elements that can perform ejection at a high frequency are densely arrayed. For this purpose, an ink supplying port and a wiring line, which are common to a predetermined number of printing elements, are prepared, and a substrate on which the ink supplying ports and the wiring lines are alternately arranged at the same pitches as an array pitch of the printing elements is also prepared.

8 Claims, 10 Drawing Sheets

(56) References Cited

U.S. PATENT DOCUMENTS

| | | | | |
|---|---|---|---|---|
| 2004/0169700 | A1* | 9/2004 | Lee | B41J 2/14056 347/56 |
| 2005/0225582 | A1* | 10/2005 | Tomita et al. | 347/12 |
| 2010/0201748 | A1 | 8/2010 | Kishikawa et al. | |
| 2010/0201754 | A1 | 8/2010 | Tsuchii et al. | |
| 2012/0056940 | A1 | 3/2012 | Sakurai et al. | |

FOREIGN PATENT DOCUMENTS

| | | | | |
|---|---|---|---|---|
| JP | 2010-179608 | A | 8/2010 | |
| JP | 2010-201921 | A | 9/2010 | |
| WO | WO 2010090042 | A1 * | 8/2010 | B41J 2/14 |

* cited by examiner

INKJET PRINT HEAD

BACKGROUND OF THE INVENTION

Field of the Invention

The present invention relates to an inkjet print head that can use heat generated from an electrothermal converting element to eject ink from an ejection port.

Description of the Related Art

An inkjet print head is configured such that a plurality of printing elements each of which can eject ink according to print data are arrayed. These days, in order to meet the demand for high-resolution and high-speed image output, the increase in the number and density of printing elements is promoted. In order to output an image at high resolution and high speed, it is necessary to increase the array density of printing elements in a print head, and at the same time quickly refill ink that is consumed along with the ejection by each of the printing elements. This is because as the refilling is more quickly completed, it is possible to more quickly transfer to the next ejecting operation so as to set the ejection frequency in each of the printing elements higher.

For example, Japanese Patent Laid-Open No. 2001-71502 discloses a configuration in which two ink supplying ports are equipped for one printing element. Such a configuration enables the ejection frequency of the print head to be kept high because even when ink is consumed along with the ejection, the ink is quickly refilled through two ink supplying ports.

However, in an inkjet print head, an ink supplying path is required for each printing element; however, wiring for providing energy necessary for ejection is also required. In such a situation, if wiring to each printing element is ensured with a number of supplying ports being prepared as in Japanese Patent Laid-Open No. 2001-71502, the print head substrate is increased in size, or it becomes difficult to have a dense array of printing elements.

SUMMARY OF THE INVENTION

The present invention is made in order to solve the above-described problems, and an objective thereof is to provide an inkjet print head in which, without causing an increase in print head size, printing elements that can perform ejection at a high frequency are densely arrayed.

In a first aspect of the present invention, there is provided an inkjet print head comprising: an electrothermal converting element group in which a plurality of electrothermal converting elements generating thermal energy for ejecting ink from ejection ports are arranged in a first direction; a plurality of ink supplying ports that are arranged at either side of the electrothermal converting element group in a second direction crossing the first direction and supply ink to the electrothermal converting element group; and a common wiring line that connects a wiring line of the electrothermal converting element group, extends to one side of the electrothermal converting element group in the first direction between the electrothermal converting element group and the ink supplying port, and supplies power to the electrothermal converting element group in common.

Further features of the present invention will become apparent from the following description of exemplary embodiments (with reference to the attached drawings).

DESCRIPTION OF THE EMBODIMENTS (First Embodiment)

Figure 1:
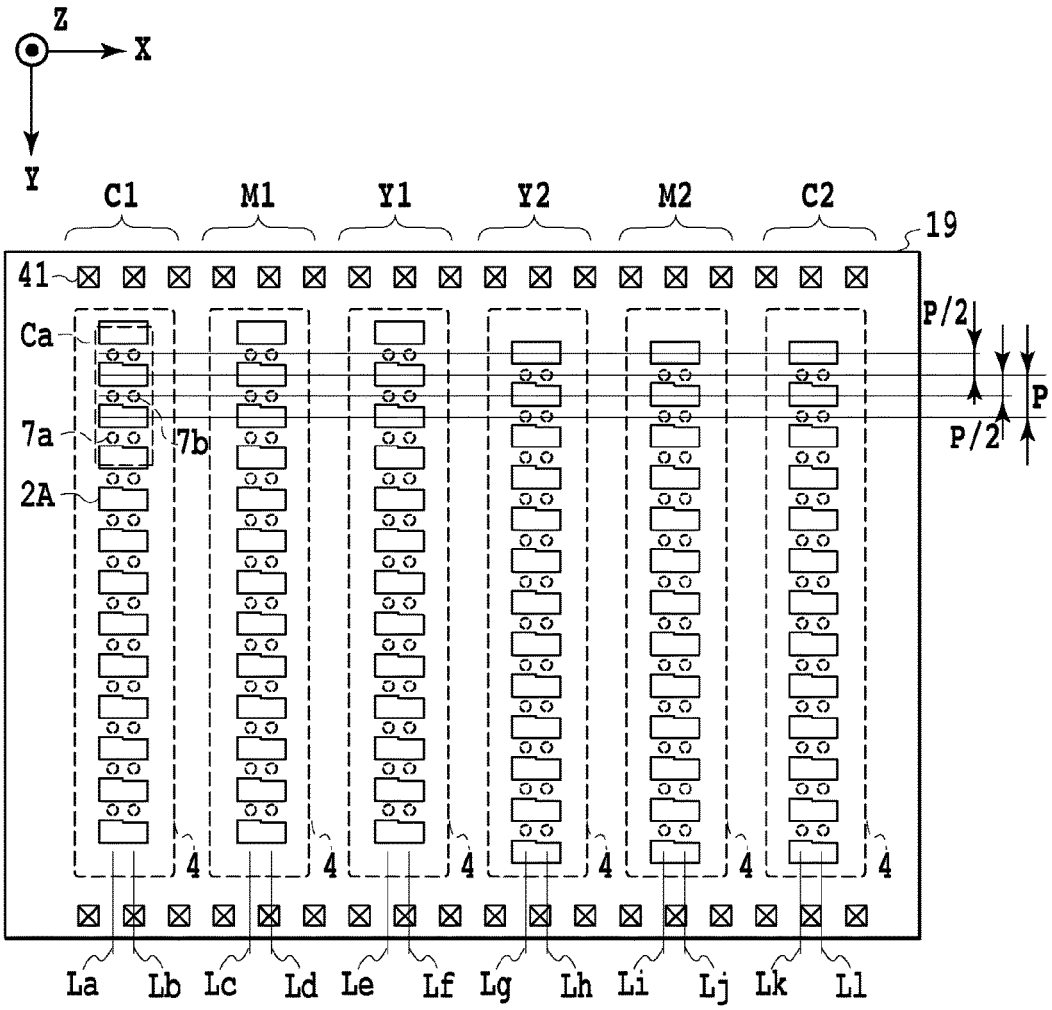
FIG. 1 is a plan view of an inkjet print head usable in the present invention.

FIG. 1 is a plan view of an inkjet print head used in the present embodiment. The print head 19 of the present embodiment is configured such that nozzle array groups C1, M1, Y1, Y2, M2, and C2 are arrayed in an X direction as illustrated in the view. The six nozzle array groups have an equivalent configuration, each of which is configured to include two parallel nozzle arrays. For example, the nozzle array groups C1 and C2 are nozzle array groups that eject cyan ink, and each of nozzle arrays La, Lb, Lk, and Ll is configured to include a plurality of printing elements that are arrayed in a Y direction at regular pitches P.

When the print head 19 ejects ink toward a printing medium while moving in the X direction (first direction), the nozzle arrays La and Lb can print cyan dots having the same size on the same line in the Y direction (second direction). That is, the nozzle arrays La and Lb can print the dots on the same line while complementing each other. As a result, dots can be printed at twice the frequency of an ejectable frequency in each of the nozzle arrays.

Also, between the nozzle arrays La and Lb of the nozzle array group C1 and the nozzle arrays Lk and Ll of the nozzle array group C2, printing elements (nozzles) are arranged so as to be displaced from each other by a half pitch (P/2) in the Y direction. Accordingly, by ejecting the ink from the respective printing elements while moving the print head 19 in the X direction, an image can be printed on the printing medium at twice the resolution of the pitch P in the Y direction. The above-described configuration can also apply to the relationship between the nozzle array groups M1 and M2, or Y1 and Y2.

Further, in the print head 19, the respective nozzle array groups are arranged in the order of C1, M1, Y1, Y2, M2, and C2, i.e., such that the ink colors are symmetrically arranged in the X direction. Accordingly, even if the print head 19 ejects the inks while moving in any of the forward and backward directions, the inks are applied to the printing medium in the order of cyan→magenta→yellow→yellow→magenta→cyan. As described, by using a uniform ink application order between forward scanning and backward scanning, color unevenness that is concerned at the time of bidirectional printing can be avoided from occurring and, therefore, bidirectional printing capable of high-speed output can be employed without any problem. As described above, the print head 19 of the present embodiment is variously elaborated to print an image at high speed.

In the view, on the back side of the respective nozzle array groups, common liquid chambers 4 are equipped. Each of the common liquid chambers 4 once accumulates corresponding ink supplied from an unillustrated ink tank, and supplies it to printing elements of a corresponding one to the nozzle array groups in common.

In positions at both ends in the Y direction with respect to the nozzle array groups, a plurality of pads 41 each of which is applied with a heater driving power supply VH supplied from an unillustrated printing apparatus main body or ground potential GND are equipped. Wiring lines connecting the pads 41 and the printing elements 7 to each other will be described later in detail.

Figure 2B:
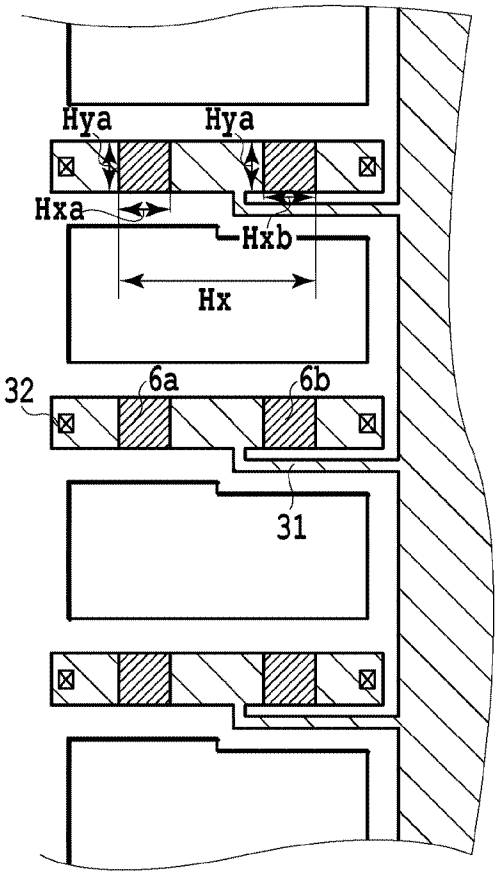
FIGS. 2A and 2B are enlarged views of a region surrounded by a dashed line Ca in FIG. 1.
Figure 2A:
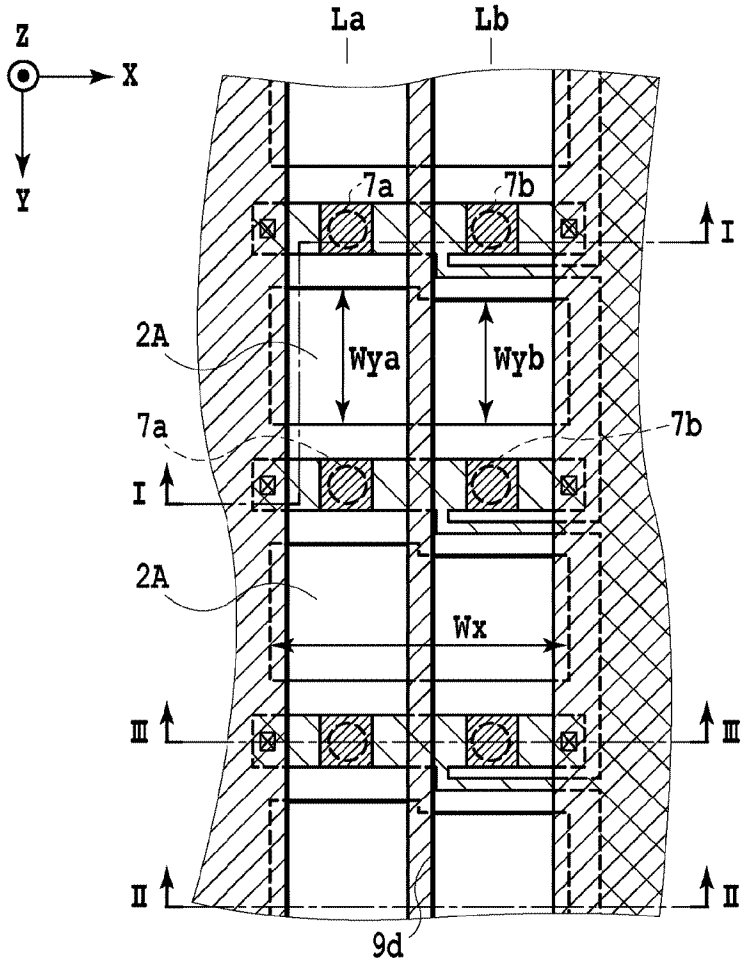

FIGS. 2A and 2B are enlarged views of a region surrounded by a dashed line Ca in FIG. 1. FIG. 2A illustrates a state where an orifice plate forming ink paths for printing elements is seen through it, and FIG. 2B illustrates a state where the orifice plate is removed.

In the present embodiment, in the interspace between any adjacent two of all printing elements that are arranged at intervals of the pitch Pin the Y direction (second direction), an ink supplying port 2A common to two printing elements 7*a* and 7*b* arranged in the X direction (first direction) is provided. Such a configuration results in a mechanism in which ink accumulated in the common liquid chambers 4 flows in a Z direction of the view through the plurality of prepared ink supplying ports 2A and supplied to respective printing elements. That is, the printing elements 7*a* and 7*b* are adapted to be replenished with the ink mainly from the two ink supplying ports 2A that are adjacent thereto in the Y direction.

Referring to FIG. 2B, in positions on a substrate, which correspond to the printing elements 7*a* and 7*b*, electrothermal converting elements 6*a* and 6*b* are arranged, respectively, and configured to be applied with voltage according to a signal inputted through a common wiring 31 and via hole 32 to eject the ink in contact therewith. As described, in the print head of the present embodiment, the ink supplying ports 2A for supplying ink to each of the printing elements and the wiring lines for supplying power are alternately arranged in the Y direction at the regular pitches P.

Figure 3B:
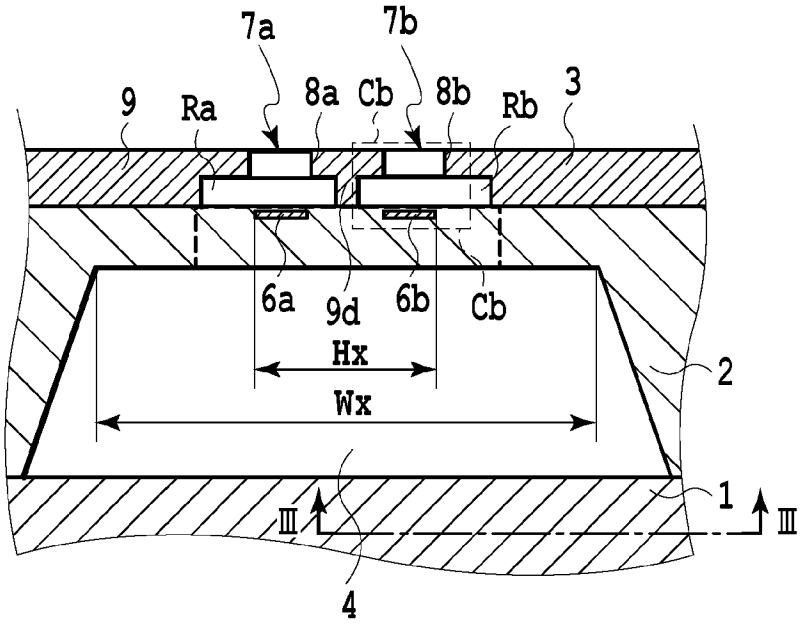
FIGS. 3A and 3B are cross-sectional views of the print head usable in the present invention.
Figure 3A:
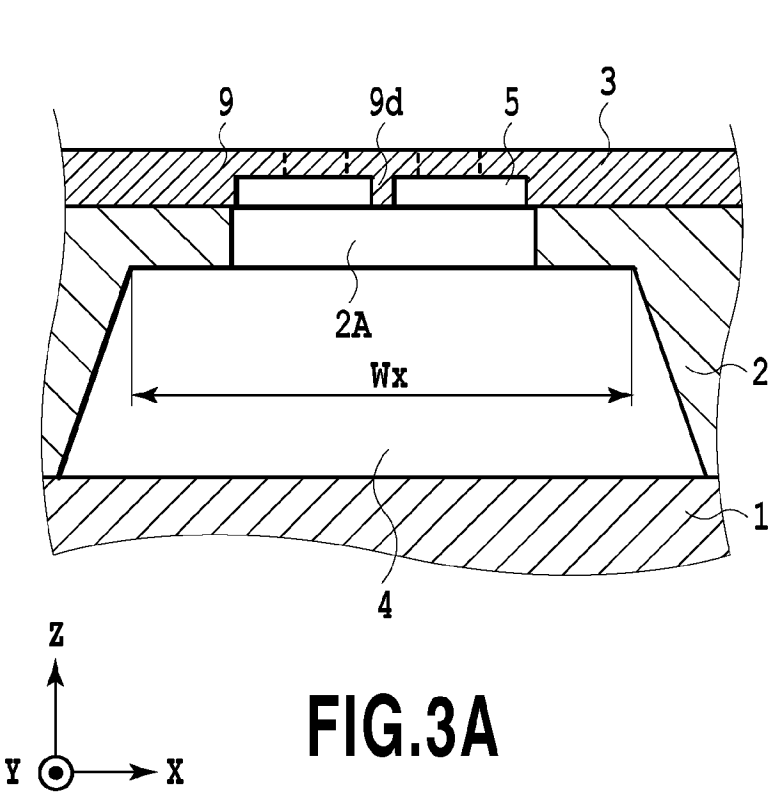
Figure 4:
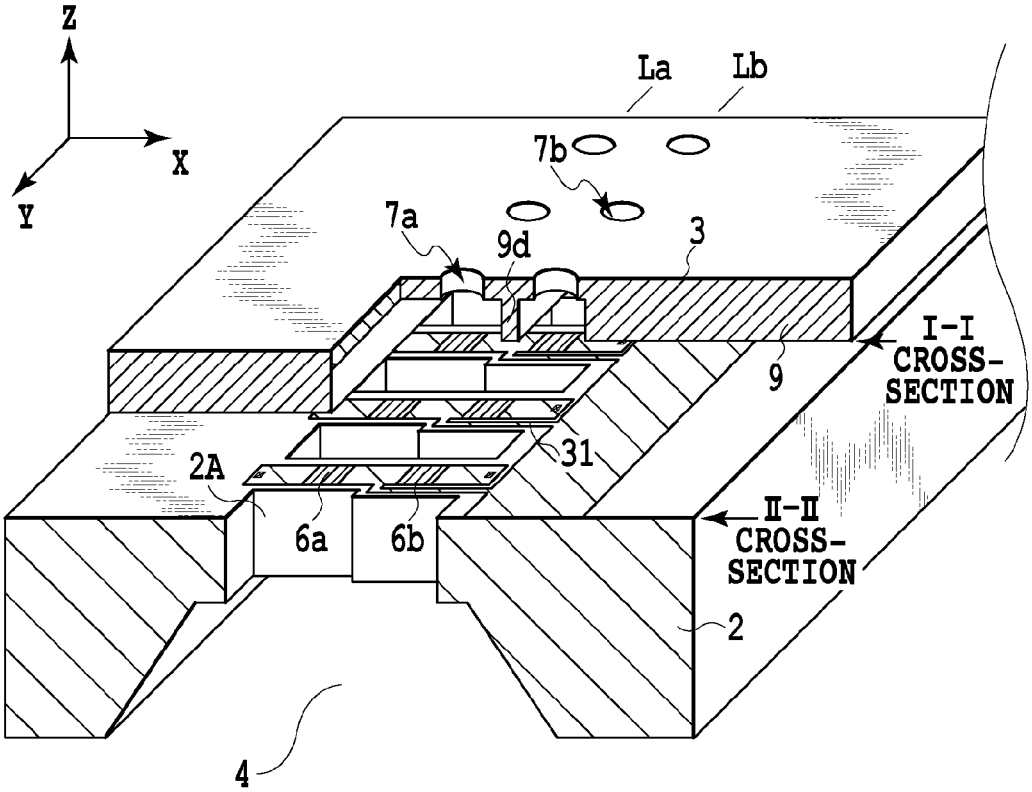
FIG. 4 is a cross-sectional perspective view of the inkjet print head usable in the present invention.

FIGS. 3A and 3B are cross-sectional views of the print head 19. FIG. 3A is the cross-sectional view that has II-II in FIG. 2A as a cross section and is intended to describe an ink supplying port 2A region. Also, FIG. 3B is the cross-sectional view that has III-III in FIG. 2A as a cross section and is intended to describe a configuration of the printing elements 7*a* and 7*b*. Further, FIG. 4 is a cross-sectional perspective view for describing states of I-I and II-II cross sections in FIG. 2A.

A support member 1, the substrate 2, and the orifice plate 3 are members that are stacked in the Z direction in this order, and can be made common to all of the nozzle arrays in the print head 19. In the substrate 2, the common liquid chamber 4 common to all printing elements in each of the nozzle array groups is formed, and supplied with ink from a corresponding one of the ink tanks.

Referring to FIG. 3A, the plurality of ink supplying ports 2A arranged in the Y direction at the predetermined pitches supplies the ink inside the common liquid chamber 4 to liquid chambers 5 respectively prepared for the nozzle arrays La and Lb. Note that each of the liquid chambers 5 is prepared for each of the nozzle arrays La and Lb, and common to the plurality of printing elements included in the nozzle array.

Referring to FIG. 3B, the printing elements 7*a* and 7*b* are configured to mainly include the electrothermal converting elements 6*a* and 6*b*, pressure chambers Ra and Rb, and ink paths 8*a* and 8*b* to the ejection ports, respectively. The electrothermal converting elements 6*a* and 6*b* are arranged on the substrate 2, and applied with voltage according to an ejection signal to thereby generate thermal energy. The pressure chambers Ra and Rb refer to regions of the liquid chambers 5, which correspond to the positions where the electrothermal converting elements 6*a* and 6*b* are arranged, and contain bubbles generated by heat generation by the electrothermal converting elements 6*a* and 6*b*, respectively. The ink paths 8*a* and 8*b* are ink flow paths formed in the orifice plate 3 in positions facing the electrothermal converting elements 6*a* and 6*b*, and they guide the ink pressed out of the pressure chambers Ra and Rb to the ejection ports, respectively.

Figure 5:
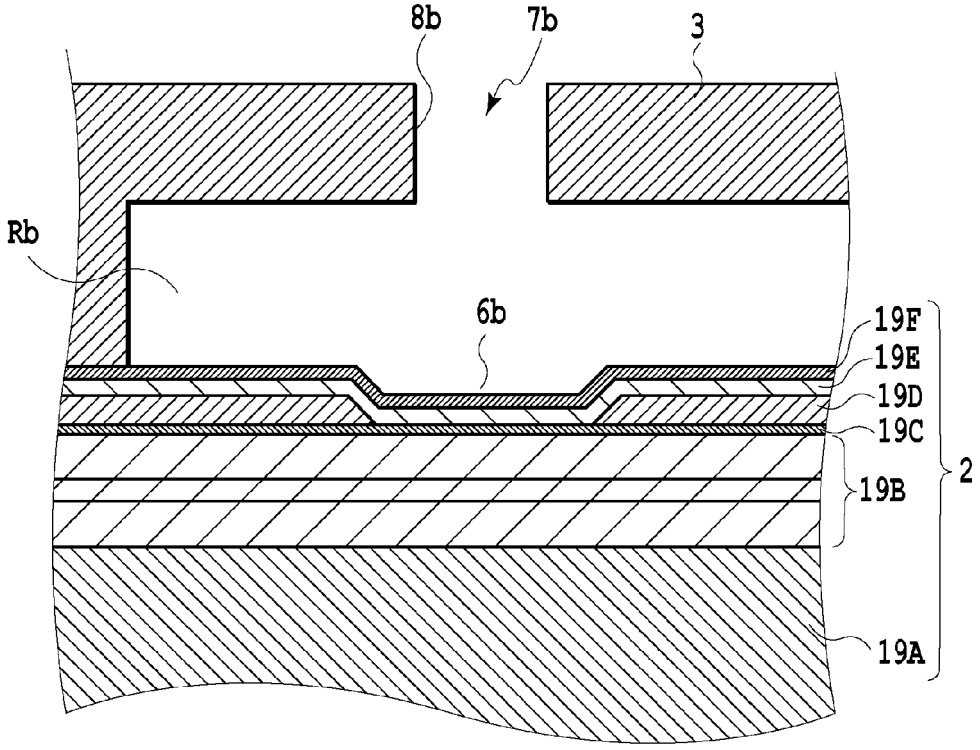
FIG. 5 is an enlarged plan view of the inkjet print head usable in the present invention.

FIG. 5 is an enlarged view of a region surrounded by a dashed line Cb in FIG. 3B, in which a layered configuration in a printing element region is illustrated. The substrate 2 described in FIGS. 3A and 3B is configured by forming thin films 19B to 19F on a silicon substrate 19A. Directly on the silicon substrate 19A, a silicon oxide film layer 19B including a plurality of interlayer films (in FIG. 5, three layers are exemplified) is formed, and as an upper layer of the interlayer films 19B, a heater wiring layer 19C is formed of TaSiN. Further, an Al layer serving as an electrical wiring layer 19D is formed while being in contact with the heater wiring layer 19C, and only a region (heater part) of the Al layer, which serves as the electrothermal converting element 6*b*, is removed by etching to expose the heater wiring layer 19C. On the basis of such a configuration, current supplied through the electrical wiring layer 19D flows to TaSiN in the region (heater part) where the Al layer is removed, and thereby structure for generating heat is demarcated. On these layers, a SiN layer is formed as a protective film 19E, which is further covered by a Ta film as a protective film 19F against cavitation applied at the time of the deformation of ink.

A space between the substrate 2 having the above-described configuration and the orifice plate 3 serves as the pressure chamber Rb that foams in the supplied ink and contains foam growth energy. When voltage is applied, according to a print signal, to the electrical wiring layer 19D positioned on both sides of the heater part 6*b*, the region where the A1 layer is removed serves as a resistor (heater part) to generate heat. By doing so, film boiling occurs in the ink inside the pressure chamber Rb by rapid heating, and due to volume expansion of a generated bubble, the ink is ejected from the ejection port as a droplet.

In the present embodiment described above, the ink inside the pressure chambers Ra and Rb is mainly supplied from the common liquid chamber 4 through the two supplying ports 2A adjacent thereto. In this case, there is no wall serving as a barrier in the flow paths from the supplying ports 2A to the pressure chambers Ra and Rb, respectively. Also, referring to FIGS. 2A and 2B again, opening sizes Wya and Wyb of the supplying port 2A in the Y direction are designed to be sufficiently larger than the inner diameter of the ejection port, and lengths Hya and Hyb of the electrothermal converting elements 6*a* and 6*b* in the Y direction, respectively. Similarly, the opening size Wx in the X direction is also designed to be larger than the distance Hx between outer end surfaces of the two electrothermal converting elements 6*a* and 6*b*, i.e., to be sufficiently larger than the length Hxa or Hcb of the electrothermal converting element 6*a* or 6*b* in the X direction. Further, in the print head 19 of the present embodiment, flow resistance of the ink in the Y direction in the pressure chamber Ra or Rb is designed to be smaller than flow resistance of the ink in the X direction.

On the basis of having a configuration as described above, the print head of the present embodiment can sufficiently ensure an ink supply amount from the supplying port 2A to the pressure chamber Ra or Rb and also keep the ink flow resistance in the corresponding path small. As a result, after ejection has been performed, the ink into the pressure chamber Ra or Rb is immediately supplied and, therefore, the ejection frequency of the printing element can be increased. Also, the pressure of the bubble generated on the heater 6*a* or 6*b* is efficiently absorbed through the supplying ports 2A adjacent in the Y direction and, therefore, the ink foaming pressure interacts, i.e., crosstalk can be reduced between the pressure chambers Ra and Rb that are adjacent to each other in the X or Y direction. Note that, in the present embodiment, in order to reduce the crosstalk between the Ra and Rb adjacent to each other in the X direction and efficiently absorb the pressure through the supplying port 2A, a wall 9*d* is also provided.

Meanwhile, according to the above-described configuration, by decreasing the distance between the electrothermal converting element 6*a* or 6*b* and the supplying port 2A, short-time refilling is achieved; however, at the same time, it is also necessary to ensure that the wiring area for the electrothermal converting element 6*a* or 5*b* is a large enough area to include an error in processing accuracy. In consideration of such situations, in the present embodiment, on a side of only one (6*b*) of the two electrothermal converting elements 6*a* and 6*b*, a wiring line 31 common to the two is extended. As a result, in the supplying port 2A, the width Wyb in the Y direction on the nozzle array Lb side is slightly smaller than the width Wya in the Y direction on the nozzle array side La. As described, in the present embodiment, by keeping the required wiring area as small as possible although still ensuring the needful area, the area of the supplying port is designed to be as large as possible.

Figure 6:
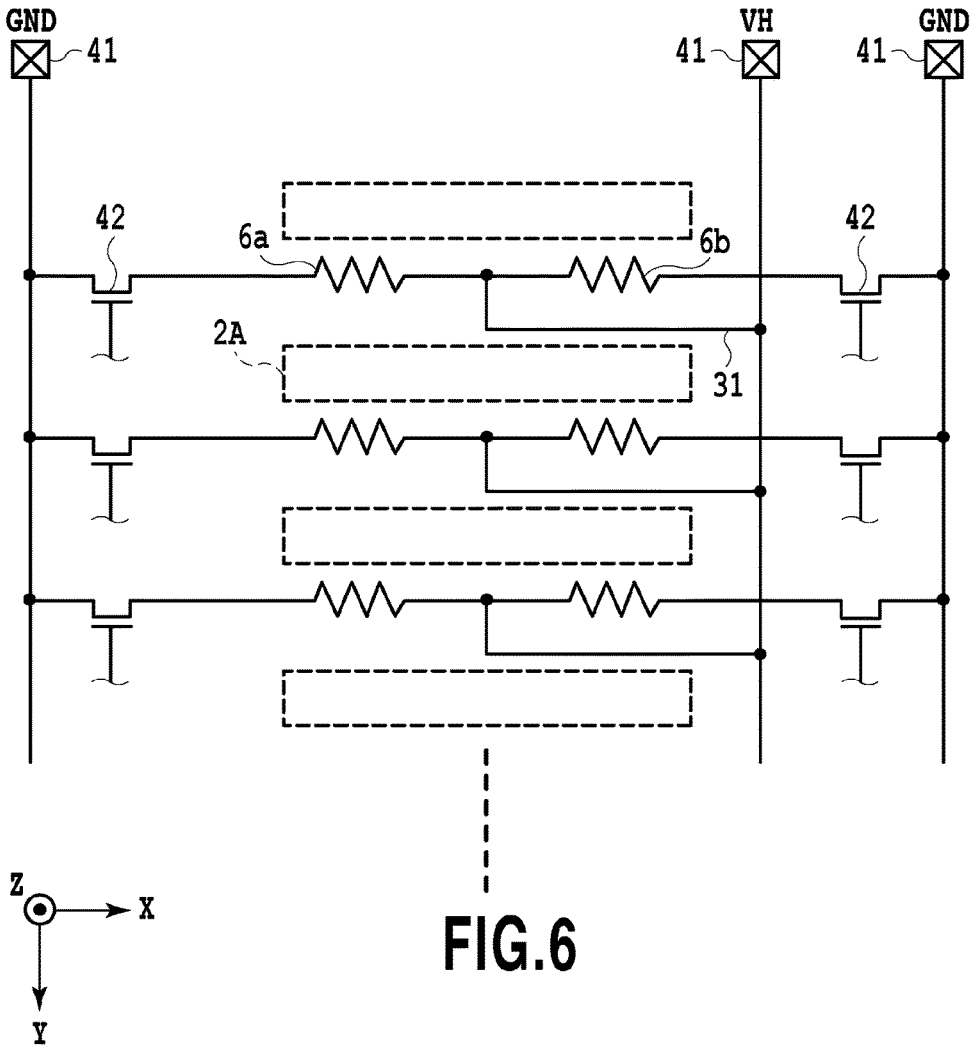
FIG. 6 is an equivalent circuit diagram for describing a relationship of connection to electrothermal transducing elements.

FIG. 6 is an equivalent circuit diagram for describing the relationship of connection to the electrothermal converting elements 6*a* and 6*b*. The pads 41 on the substrate described in FIG. 1 are respectively connected to the two GND and the heater driving power supply VH supplied from the printing apparatus main body. The VH power supply is drawn out in the Y direction by a wiring line, and connected with the common wiring line 31 each of which is arranged for every two electrothermal converting elements 6*a* and 6*b* arranged between the supplying ports 2A. The other terminals of the two electrothermal converting elements 6*a* and 6*b* are respectively drawn out to both sides of the supplying port 2A, and connected to drain terminals of driving transistors 42 that are arranged on both sides sandwiching the supplying port 2A and driving elements for the electrothermal converting elements. The gate terminal of each of the driving transistors 42 is inputted with an energization control signal conforming print data from a logic circuit, and thereby on/off of the driving transistor 42 is controlled at intervals of predetermined timing. In FIG. 2, for simplicity, the driving transistors 42 and pads 41 are not illustrated, and a wiring pattern to the via holes 32 connected to the drain terminals of the driving transistors 42 is illustrated.

As described above, according to the present embodiment, a wiring line common to the two electrothermal converting elements is extended on the side of one of the two electrothermal converting elements. Then, the wiring lines to respective printing elements are ensured, and at the same time, the ink supplying ports each having a large opening that can prevent crosstalk between the pressure chambers are alternately arranged at the same pitches as those of the wiring lines and printing elements. This enables a high-resolution and high-quality image to be outputted at a high ejection frequency and high speed without causing an increase in print head size.

(Second Embodiment)

Figure 7B:
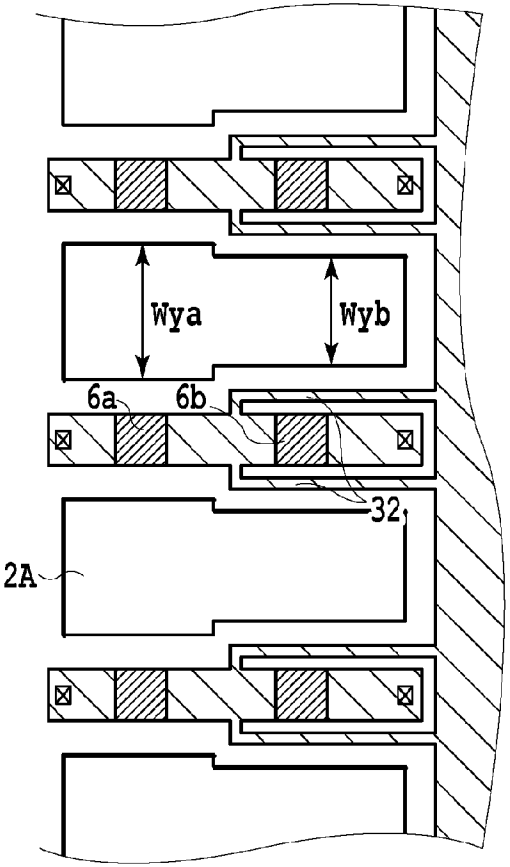
FIGS. 7A and 7B are diagrams illustrating a printing element substrate in a second embodiment.
Figure 7A:
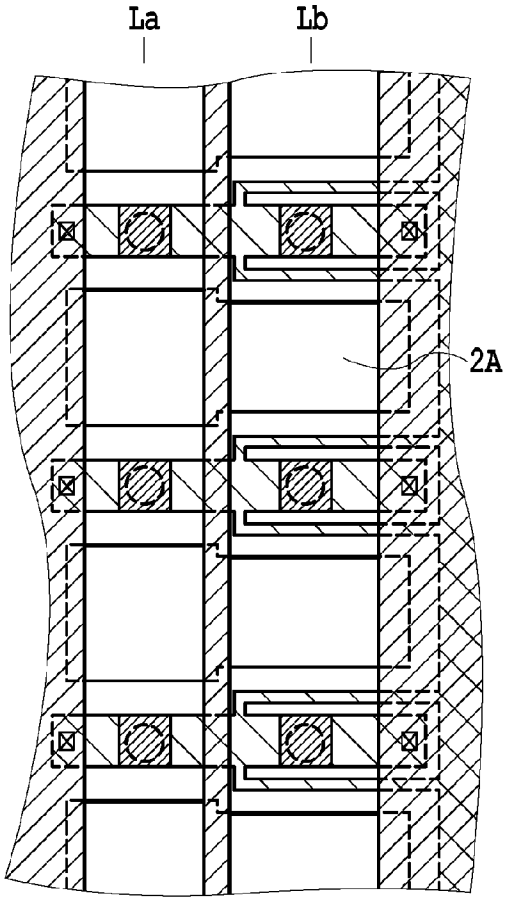

FIGS. 7A and 7B are diagrams describing a printing element substrate in the present embodiment in the same manner as that for FIGS. 2A and 2B. FIG. 7A illustrates a state where an orifice plate formed with an ink path for each printing element is seen through it, and FIG. 7B illustrates a state where the orifice plate is removed.

The present embodiment is different from the first embodiment in that for every two electrothermal converting elements 6*a* and 6*b*, two common wiring lines 32 are connected. The pair of common wiring lines 32 is extended on the side of one (6*b*) of the electrothermal converting elements 6*a* and 6*b*. This causes, in a supplying port 2A of the present embodiment, the width Wyb in a Y direction on the nozzle array Lb side to be smaller as compared with that in the first embodiment.

In the asymmetric configuration with respect to the Y direction as in the first embodiment, the ink ejection angle is slightly displaced in the Y direction, which may influence placement position accuracy. In the case where particularly highly accurate placement position accuracy is required, by making the configuration symmetric with respect to the Y direction as in the present embodiment, the ink ejection angle can be stabilized to ensure a highly accurate placement position on paper.

Further, arranging the two common wiring lines 32 as in the present embodiment results in keeping wiring resistance, i.e., power consumption in wiring is small as compared with the first embodiment to more efficiently supply power to the electrothermal converting elements 6*a* and 6*b*. On the other hand, in the case where it is not necessary to reduce wiring resistance, the two wiring lines can also be made narrower than that in the first embodiment to increase the width Wyb of the supplying port 2A in the Y direction accordingly.

(Third Embodiment)

Figure 8B:
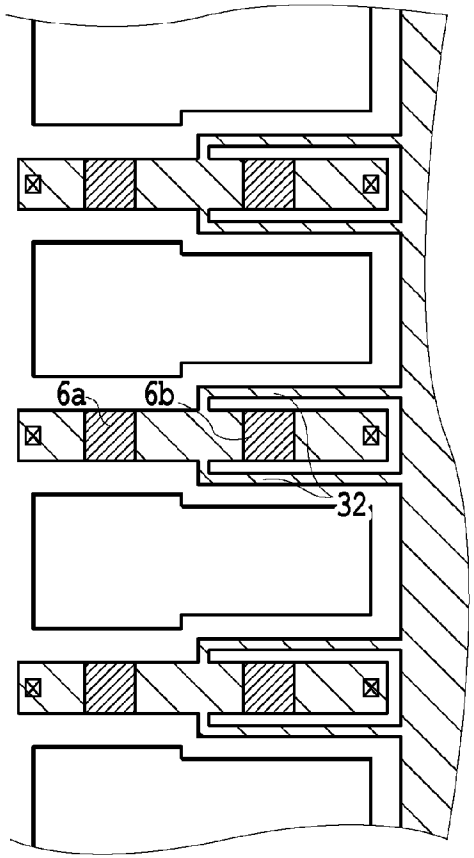
FIGS. 8A and 8B are diagrams illustrating a printing element substrate in a third embodiment.
Figure 8A:
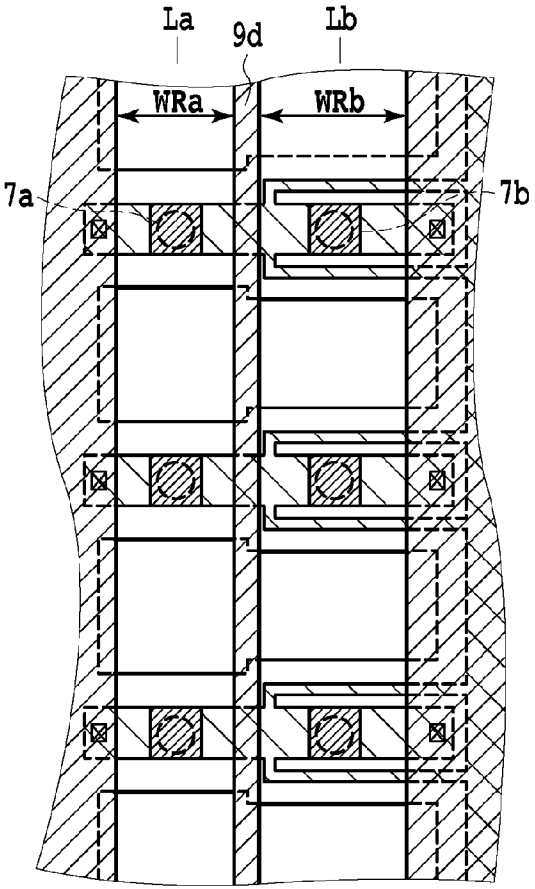

FIGS. 8A and 8B are diagrams describing a printing element substrate in the present embodiment in the same manner as that for FIGS. 2A and 2B. FIG. 8A illustrates a state where an orifice plate formed with an ink path for each printing element is seen through it, and FIG. 8B illustrates a state where the orifice plate is removed.

In the present embodiment, the wiring configuration for two electrothermal converting elements 6*a* and 6*b* is the same as that in the second embodiment. However, in the present embodiment, the position of the wall 9*d* is displaced toward the nozzle array La side, and widths in an X direction, i.e., volumes of pressure chambers Ra and Rb are made different.

In the case of, on the nozzle array Lb side, providing the two wiring lines for each electrothermal converting element pair as in the second embodiment, the distance from the ink supplying port 2A to the electrothermal converting element 6b is increased according to an increase in area for the wiring, and then the flow path resistance also increases. That is, the period of time required to refill the nozzle array Lb becomes longer than the period of time required to refill the nozzle array La. However, as in the present embodiment, by increasing the width of the liquid chamber 5, the flow rate from the supplying port 2A to the electrothermal converting element 6b is increased and, therefore, the period of time required for refilling can be shortened. That is, by adjusting the position of the wall 9*d* between the nozzle arrays La and Lb, the period of time required for refilling, i.e., the ejection frequency can be made uniform between the nozzle arrays.

(Fourth Embodiment)

Figure 9B:
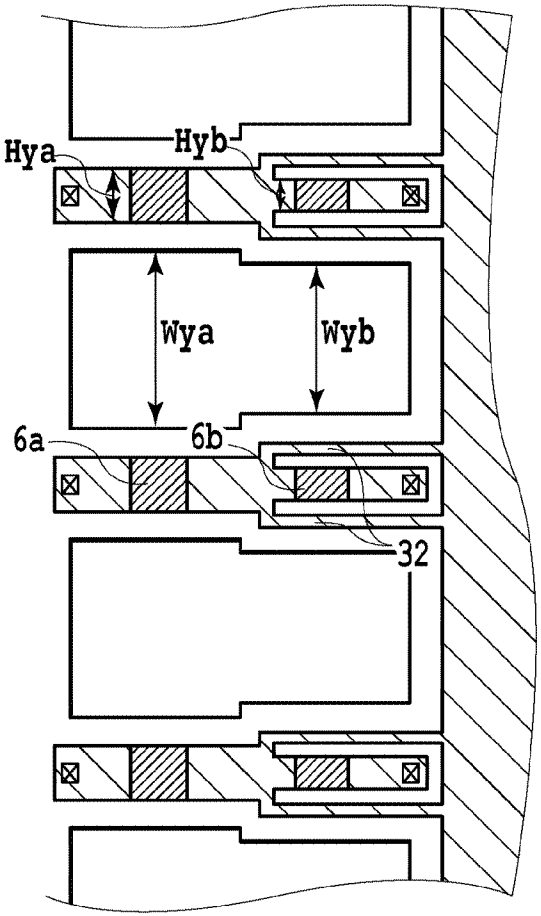
FIGS. 9A and 9B are diagrams illustrating a printing element substrate in a fourth embodiment.
Figure 9A:
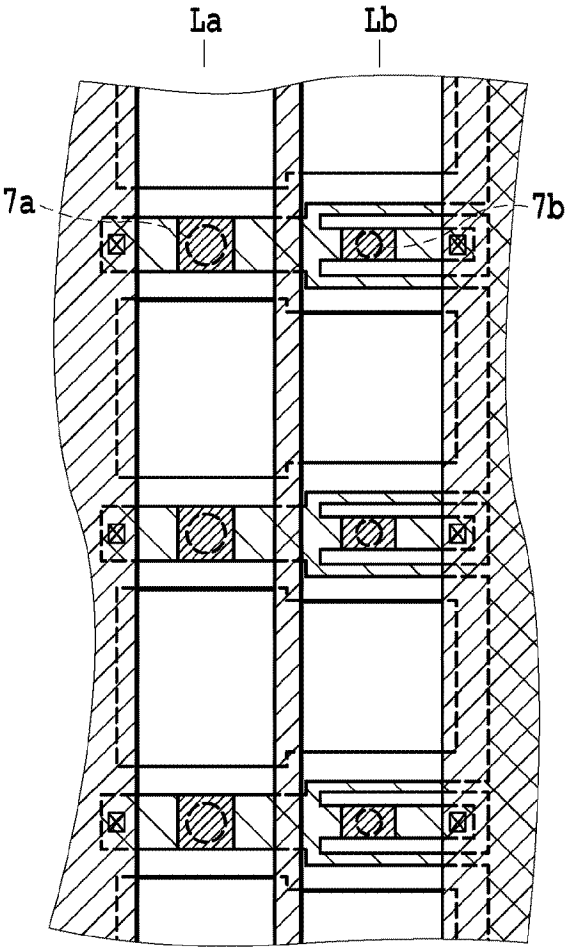

FIGS. 9A and 9B are diagrams describing a printing element substrate in the present embodiment in the same manner as that for FIGS. 2A and 2B. FIG. 9A illustrates a state where an orifice plate formed with an ink path for each printing element is seen through it, and FIG. 9B illustrates a state where the orifice plate is removed.

In the present embodiment, different sizes are made between two electrothermal converting elements 6*a* and 6*b*. Specifically, the width Hyb of the electrothermal converting element 6*b* in a Y direction is made smaller than the width Hya of the electrothermal converting element 6*a* in the Y direction. Further, along with this, the ejection port diameter of the printing element 7*b* is made smaller than that of the printing element 7*a*. By employing such a configuration, in the present embodiment, the amount of ink ejected by the nozzle array Lb is intentionally made smaller than the amount of the ink ejected by the nozzle array La. As described, in the case of using a print head that can eject ink having the same color but in a different amount, gradation performance of each pixel can be increased and, therefore, a higher-quality image can be outputted.

In the case of the print head having the above configuration, by providing wiring lines 32 on the side of the printing element having the smaller ejection amount, opening sizes Wya and Wyb of the supplying port 2A in the Y direction can be uniformly and widely ensured. In the diagram, for every two electrothermal converting elements 6*a* and 6*b*, two common wiring lines 32 are provided in the same manner as that in the second embodiment; however, the opening size of the supplying port 2A in the Y direction is made larger than that in the second embodiment according to a decrease in Hyb.

In the case of the present configuration, according to the decrease in width Hyb of the electrothermal converting element 6*b*, the distance from the electrothermal converting element 6*b* to the supplying port 2A is increased; however, the amount of the ink to be supplied to the printing element 7*b* having a smaller ejection amount is essentially small. That is, the influence on the period of refilling time is compensated mutually by the increase in supply distance and the decrease in supply amount and, therefore, the ejection frequency can be made uniform to some extent between the two printing elements 7*a* and 7*b*.

Note that, in FIGS. 9A and 9B, described is the configuration in which for every two electrothermal converting elements 6*a* and 6*b*, two common wiring lines 32 are connected; however, in the present embodiment, even the case of one common wiring line arranged for every two electrothermal converting elements is available, without doubt.

(Fifth Embodiment)

Figure 10B:
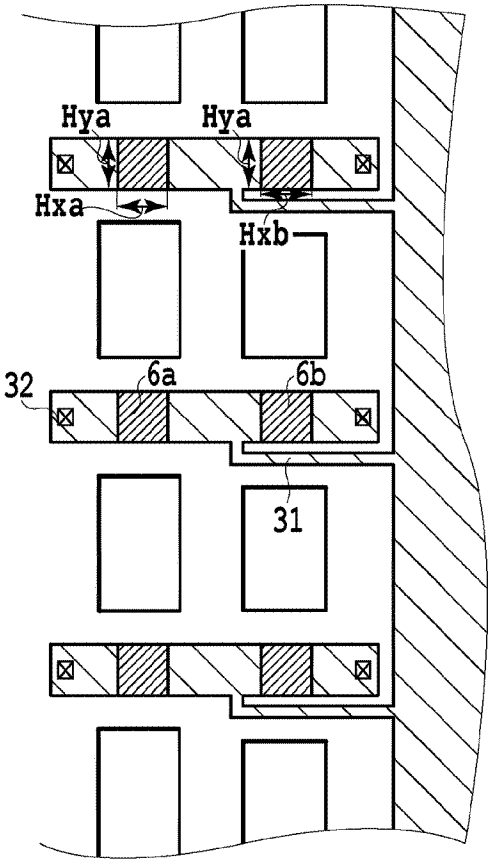
FIGS. 10A and 10B are diagrams illustrating a printing element substrate in a fifth embodiment.
Figure 10A:
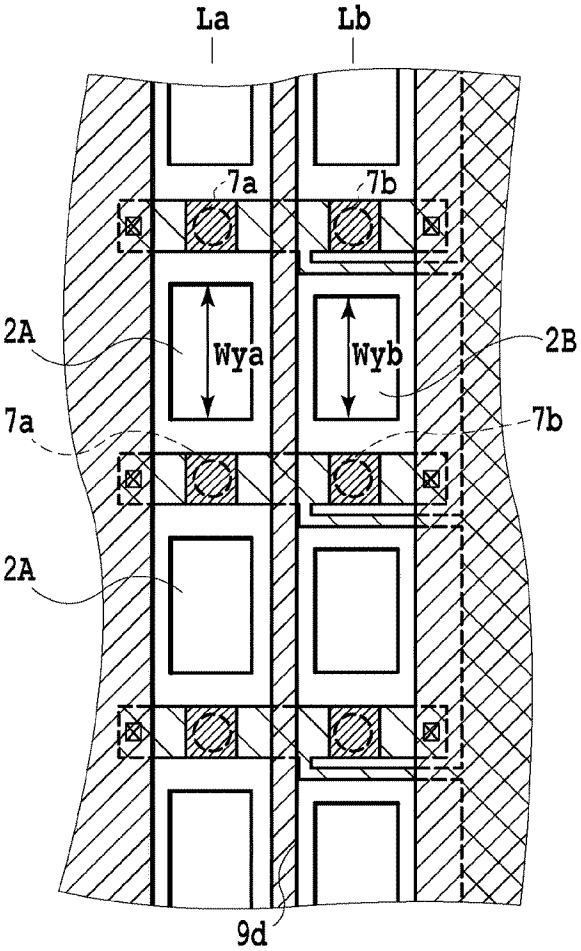

FIGS. 10A and 10B are diagrams illustrating a printing element substrate in the present embodiment in the same manner as that for FIGS. 2A and 2B. FIG. 10A illustrates a state where an orifice plate formed with an ink path for each printing element is seen through, and FIG. 10B illustrates a state where the orifice plate is removed.

In the present embodiment, the wiring configuration for two electrothermal converting elements 6*a* and 6*b* is the same as that in the second embodiment. A feature of the present embodiment is that an ink supplying port corresponding to the two electrothermal converting elements 6*a* and 6*b* is separated into two ports 2A and 2B. Also, another feature of the present embodiment is that between pressure chambers Ra and Rb adjacent to each other in an X direction, a wall 9*d* is provided. Such a configuration is useful in reducing crosstalk.

In the case of the occurrence of an influence of crosstalk, as a countermeasure against it, generally, after taking time approximately necessary for the influence of crosstalk associated with driving of some electrothermal converting element to converge, an adjacent electrothermal converting element is driven. However, this results in a reduction in printing speed. On the other hand, in the configuration of the present embodiment, the wall 9*d* is provided between the pressure chambers Ra and Rb, and therefore it is possible to simultaneously drive 6*a* and 6*b* or reduce a driving time interval between 6*a* and 6*b* to prevent the reduction in printing speed.

Also, a width Wyb of the supplying port 2B in a Y direction is slightly smaller than a width Wya of the supplying port 2A in the Y direction. As described, in the present embodiment, by while ensuring a required wiring area, suppressing the area as much as possible, areas of the supplying ports are designed to be as large as possible.

As described above, according to the present invention, in the substrate of the print head that uses thermal energy to eject the inks, a wiring line common to a electrothermal converting element group consisting of the two electrothermal converting elements is extended on the side of the two. This enables a width of the ink supplying port in a side where the wiring is not extended to be reduced and, therefore, a high-resolution and high-quality image can be outputted at a high ejection frequency and high speed without causing an increase in print head size.

Note that, in any of the above-described embodiments, a common supplying port 2A and (a) common wiring line(s) 31 are prepared for two electrothermal converting elements; however, the present invention is available, without doubt, even for a configuration in which for a group of three or more electrothermal converting elements, a common supplying port and a common wiring line are prepared. Also, the number of wiring lines common to such an electrothermal converting element group is not limited to one or two as in any of the above-described embodiments but may be three or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-249621, filed Nov. 15, 2011 and No. 2012-231651, filed Oct. 19, 2012, which are hereby incorporated by reference herein in their entirety.

What is claimed is:

1. An inkjet print head comprising:

an orifice plate provided with ejection ports for ejecting ink; and a substrate, the substrate including:

a plurality of energy generating element groups, in each of which a first energy generating element and a second energy generating element for ejecting ink are arranged along a first direction within a predetermined distance and are connected to each other by a wiring line;

a plurality of supplying ports that pass completely through the substrate and each have a width greater than the predetermined distance in the first direction; and a plurality of first common wiring lines that connect to the wiring lines of the plurality of energy generating element groups, respectively, wherein the plurality of supplying ports and the plurality of energy generating element groups are arranged alternately in a second direction perpendicular to the first direction and the first and the second energy generating elements of each energy generating element group are supplied with ink from the supplying ports adjacent to the energy generating element group in the second direction, and each of the plurality of first common wiring lines extends in the first direction between one of the first energy generating elements and one of the supplying ports and is connected to the corresponding wiring line at a point between the first energy generating element and the second energy generating element.

2. The inkjet print head according to claim 1, wherein in each of the first energy generating element and the second energy generating element, one terminal of each element is connected to the wiring line, which connects to one of the first common wiring lines, and the other terminal of each element is connected to a different wiring line to ground, respectively.

3. The inkjet print head according to claim 1, wherein a dimension of each of the supplying ports in the second direction on the side, in the first direction, where the first common wiring line does not extend is greater than the dimension on the side where the first common wiring line extends.

4. The inkjet print head according to claim 1, further comprising:

a plurality of second common wiring lines that connect to the wiring lines of the plurality of energy generating element groups, respectively, wherein, in each of the energy generating element groups, the first common wiring line and the second common wiring line extend in the first direction symmetrically with respect to the first and second energy generating elements.

5. The inkjet print head according to claim 1, wherein an area of the first energy generating element on the side where the first common wiring line extends is smaller than the area of the second energy generating element on the side where the first common wiring line does not extend.

6. The inkjet print head according to claim 1, wherein the substrate has a face on which the plurality of energy generating element groups and the plurality of first common wiring lines are arranged and the plurality of supplying ports pass completely from the face to an opposite face of the substrate.

7. The inkjet print head according to claim 6, wherein the orifice plate has the ejection ports corresponding to each of the first and second energy generating elements and forms pressure chambers with the substrate, the pressure chambers being communicated with the respective ejection ports and being able to contain bubbles in the ink caused by thermal energy generated by the first and second energy generating elements.

8. The inkjet print head according to claim 7, wherein one of the pressure chambers, on the side where the first common wiring line extends, is larger than the pressure chamber on the side where the first common wiring line does not extend.

* * * * *